US011235953B2

(12) United States Patent
Cambruzzi et al.

(10) Patent No.: US 11,235,953 B2
(45) Date of Patent: Feb. 1, 2022

(54) METHOD AND ASSEMBLY DEVICE FOR CARRYING OUT AN INSTALLATION PROCESS IN AN ELEVATOR SHAFT OF AN ELEVATOR SYSTEM

(71) Applicant: Inventio AG, Hergiswil (CH)

(72) Inventors: Andrea Cambruzzi, Zurich (CH); Erich Bütler, Ebikon (CH); Philipp Zimmerli, Harkingen (CH); Raphael Bitzi, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 291 days.

(21) Appl. No.: 16/492,187

(22) PCT Filed: Mar. 22, 2018

(86) PCT No.: PCT/EP2018/057325
§ 371 (c)(1),
(2) Date: Sep. 9, 2019

(87) PCT Pub. No.: WO2018/177888
PCT Pub. Date: Oct. 4, 2018

(65) Prior Publication Data

US 2021/0139286 A1 May 13, 2021

(30) Foreign Application Priority Data

Mar. 27, 2017 (EP) ..... 17163132

(51) Int. Cl.
*B66B 19/00* (2006.01)

(52) U.S. Cl.
CPC ..... *B66B 19/002* (2013.01)

(58) Field of Classification Search
CPC ..... B66B 19/002
(Continued)

(56) References Cited

U.S. PATENT DOCUMENTS 4,893,398 A 1/1990 Zimmer
6,013,017 A 1/2000 Aizawa
(Continued)

FOREIGN PATENT DOCUMENTS

CN 1721311 A 1/2006
CN 103904786 A 7/2014
(Continued)

*Primary Examiner* — Jeffrey Donels
(74) *Attorney, Agent, or Firm* — William J. Clemens; Shumaker, Loop & Kendrick, LLP

(57) ABSTRACT

A method and a mounting device for carrying out an installation operation in an elevator shaft of an elevator system include a mounting device having a carrier component and a mechatronic installation component held on the carrier component. In a displacement phase, the carrier component is displaced relative to the elevator shaft and positioned at different heights within the elevator shaft. In a mounting phase, a mounting step is carried out at least partially automatically, wherein a mounting device is removed from a magazine component disposed on the carrier component and installed on a shaft wall of the elevator shaft. In a stocking phase, a magazine component is stocked with mounting devices outside the elevator shaft and, in a loading phase, the stocked magazine component is disposed on the carrier component.

13 Claims, 2 Drawing Sheets

(58) Field of Classification Search
USPC ..... 187/408
See application file for complete search history.

(56) References Cited

U.S. PATENT DOCUMENTS

| | | | | |
|---|---|---|---|---|
| 11,111,109 | B2 * | 9/2021 | Cambruzzi | B66B 19/00 |
| 2015/0314992 | A1 * | 11/2015 | Bolme | B66B 5/0087 52/741.1 |
| 2016/0311657 | A1 * | 10/2016 | Kilpelainen | B66B 19/002 |
| 2018/0208438 | A1 * | 7/2018 | Cambruzzi | B66B 7/02 |
| 2018/0208439 | A1 * | 7/2018 | Studer | B66B 7/024 |
| 2019/0112159 | A1 * | 4/2019 | Cambruzzi | B66B 19/007 |
| 2019/0367328 | A1 * | 12/2019 | Cambruzzi | B32B 37/00 |
| 2020/0055709 | A1 * | 2/2020 | Cambruzzi | G01B 5/25 |
| 2020/0165105 | A1 * | 5/2020 | Zhao | B66B 19/002 |
| 2020/0299105 | A1 * | 9/2020 | Cambruzzi | B66B 19/002 |

FOREIGN PATENT DOCUMENTS

| | | | |
|---|---|---|---|
| CN | 104169196 | A | 11/2014 |
| CN | 104453916 | A | 3/2015 |
| CN | 104884378 | A | 9/2015 |
| CN | 105384035 | A | 3/2016 |
| CN | 103904786 | B | 7/2016 |
| CN | 104169196 | B | 9/2016 |
| JP | 3034960 | B2 | 4/2000 |
| JP | 3214801 | B2 | 10/2001 |
| JP | 2016084187 | A | 5/2016 |
| RU | 2263621 | C1 | 11/2005 |
| WO | 2017016780 | A1 | 2/2017 |
| WO | 2017016783 | A1 | 2/2017 |

* cited by examiner

METHOD AND ASSEMBLY DEVICE FOR CARRYING OUT AN INSTALLATION PROCESS IN AN ELEVATOR SHAFT OF AN ELEVATOR SYSTEM

FIELD

The invention relates to a method for carrying out an installation operation in an elevator shaft of an elevator system and to a mounting device for carrying out an installation operation in an elevator shaft of an elevator system.

BACKGROUND

WO 2017/016783 A1 describes a method and a mounting device for carrying out an installation operation in an elevator shaft of an elevator system. The mounting device has a carrier component and a mechatronic installation component in the form of an industrial robot held at the carrier component. With the aid of a displacement component situated above the mounting device in the elevator shaft and a suspension means, the carrier component and thus the mounting device can be displaced in a displacement phase in the elevator shaft. Moreover, the mounting device has a fixing component, with the aid of which it can be fixed in a desired position in the elevator shaft in the horizontal direction and, by using the installation component, can in this way carry out at least semi-automatic mounting steps in a mounting phase. In this case, the installation component removes mounting means in the form of rail brackets, also called brackets, and fastening means in the form of screws from a magazine component situated on the carrier component and installs them on a shaft wall of the elevator shaft. In this instance, the magazine component is fixedly disposed on the carrier component. To stock the magazine component with mounting means, the magazine component, and thus the carrier component, has to be positioned so that the mounting means can be placed individually in the magazine component.

SUMMARY

In contrast, it is in particular an object of the present invention to propose a method and a mounting device for carrying out an installation operation in an elevator shaft of an elevator system which enables to quickly carry out the installation operation and, in particular, to quickly supply the mounting device with mounting means.

In the method according to the present invention for carrying out an installation operation in an elevator shaft of an elevator system using a mounting device, which has a carrier component and a mechatronic installation component held on the carrier component, the carrier component in a displacement phase is displaced in relation to the elevator shaft and is positioned at different heights within the elevator shaft. In a mounting phase, a mounting step is carried out at least partially automatically, a mounting means being removed from a magazine component disposed on the carrier component and being installed on a shaft wall of the elevator shaft.

According to the present invention, a magazine component in a stocking phase is stocked with mounting means outside of the elevator shaft, and in a loading phase, the stocked magazine component is disposed on the carrier component.

The rather time-consuming stocking of the magazine component with mounting means can thus be carried out independently of the mounting device, that is, also during a displacement or mounting phase. For this reason, the mounting device only during the comparatively short stocking phase has to be positioned in the elevator shaft in such a manner that the stocked magazine component can be disposed on the carrier component. The necessary interruption of the productive displacement or mounting phases is thus very short, as a result of which a comparatively fast implementation of the entire installation operation is made possible.

A quick stocking of the magazine component with mounting means is particularly important because the magazine component, for space and weight reasons, usually cannot accommodate all mounting means for the entire elevator shaft and, for this reason, a loading phase is necessary several times during installation.

The mounting device according to the present invention for carrying out an installation operation in an elevator shaft of an elevator system has a carrier component and a mechatronic installation component held on the carrier component. The carrier component is configured to be displaced in a displacement phase relative to the elevator shaft and to be positioned at different heights within the elevator shaft. The installation component is configured to at least partially automatically carry out a mounting step in a mounting phase and, in this instance, to remove a mounting means from a magazine component disposed on the carrier component and to install it on a shaft wall of the elevator shaft.

According to the present invention, the carrier component has a magazine receiving device which can assume a mounting position and a loading position. The carrier component and the magazine receiving device are configured and disposed in such a manner that, in the mounting position, a mounting means from a magazine component disposed on the magazine receiving device can be removed from the installation component and the carrier component can be displaced in the elevator shaft. Moreover, a stocked magazine component can, in the loading position, be disposed on the magazine receiving device via an accessible door cutout of the elevator shaft.

The mounting device according to the present invention has the same advantages as the described method according to the present invention.

The described installation operation in particular concerns a fixing of rail brackets to shaft walls of the elevator shaft. Such rail brackets are also referred to as brackets. Via the rail brackets, guide rails for an elevator car of the elevator system are fixed to the shaft walls in a subsequent installation step, which can be carried out by an installer manually or also at least partially in an automated manner.

The carrier component can be configured in different ways. For example, the carrier component may be designed as a simple platform, framework, scaffold, cab, or the like.

The installation component is intended to be mechatronic, meaning that it is intended to have interacting mechanical, electronic and information-technology elements or modules. The installation component may in particular be designed as an industrial robot.

The mounting device can in particular be designed in accordance with a mounting device described in WO 2017/016783 A1.

For displacing the carrier component within and thus relative to the elevator shaft, a displacement component is provided, which is situated in particular above the mounting device in the elevator shaft and is connected to the carrier component via a suspension means. In this instance, the displacement component can be disposed in the elevator shaft or above the elevator shaft. The displacement component may, for example, be designed as a kind of cable winch, in which the suspension means, for example in the form of a flexible cable or chain, can be wound around a winch driven, for example, by an electric motor.

In particular, a fixing phase is carried out between the displacement phase and the mounting phase, in which the carrier component is fixed within the elevator shaft in the lateral direction, meaning in the horizontal direction. Fixing in the lateral direction should be understood to mean that the carrier component together with the installation component attached thereto not only can be moved vertically, with the aid of the displacement component and the suspension means, into a position at a desired height within the elevator shaft, but that the carrier component, with the aid of the fixing component, then also can be fixed in this position in the horizontal direction. After completion of the fixing phase, the carrier component on the one hand no longer has to be held by the suspension means and, on the other hand, can support forces that occur when performing a mounting step, for example, when drilling a hole in a shaft wall.

For this purpose, the mounting device in particular has a fixing component, with the aid of which the carrier component can be fixed within the elevator shaft in the lateral direction. For this purpose, the fixing component, for example, may be designed to be laterally supported or wedged against the walls of the elevator shaft such that the carrier component can no longer move relative to the walls in the horizontal direction. For this purpose, the fixing component, for example, may have suitable supports, props, levers or the like.

In the mounting phase, in particular a plurality of mounting steps is carried out, in at least one of the mounting steps a mounting means being removed from a magazine component disposed on the carrier component and being installed on a shaft wall of the elevator shaft. In particular, a rail bracket is automatically installed on the shaft wall. For this purpose, two holes are first drilled into the shaft wall. Subsequently, two screws are successively removed from the magazine component, a portion of which are screwed into the drilled holes. Then a specially designed rail bracket is removed from the magazine component and hung on the two screws. Finally, the two screws are completely screwed in. In so doing, two screws and a rail bracket, and thus three mounting means, are installed on the shaft wall in these mounting steps. The mounting steps can be carried out in particular as described in WO 2017/016781 A1.

The mounting means removed from the magazine component can also generally be configured as so-called shaft material, for example as bolts, screw anchors, sensors, switches, holders for sensors or switches, shaft lighting, clips, connecting elements between guide rails, so-called fishplates, or the like.

During the stocking phase, the magazine component is stocked with mounting means. This is to be understood as meaning that the mounting means are placed or disposed in the magazine component. The magazine component has in particular special intakes for the mounting means, in which the mounting means are situated. This ensures that the installation component can safely remove the mounting means in a mounting phase. The mounting means can be disposed one above the other in particular in a plurality of planes. In order to enable a safe removal of the mounting means also in this case, the magazine component may have springs, which press the mounting means in the direction of a retrieval opening of the magazine component.

The mounting means are disposed in particular symmetrically in the magazine component. In doing so, a uniform weight distribution in the magazine component can be achieved when the mounting means are correspondingly retrieved.

The stocking of the magazine component can take place in the vicinity of the elevator shaft, thus at the construction site itself. It is, however, also possible that the stocking of the magazine components takes place outside the construction site, for example in a factory, and that the magazine components are delivered to the construction site after being already stocked.

In order to enable an easy transport of the magazine component, the magazine component has in particular rollers, on which it can be pushed.

Before disposing a stocked magazine component in the loading phase, in particular an emptied magazine component is removed in order to make room for the stocked magazine component.

The carrier component has in particular a magazine receiving device which can accommodate the magazine component. For this purpose, the magazine receiving device can have, for example, a platform or a base, onto which the magazine component can be pushed. It may also have, for example, grooves into which rails of the magazine component can be inserted.

One or a plurality of, in particular two, magazine components can be disposed on the carrier component. The one or plurality of magazine components is in particular disposed on the carrier component in such a way that the resulting weight force of the magazine components runs through the center of gravity of the mounting device.

The stocked magazine component, in particular, is disposed via an accessible door cutout of the elevator shaft on the carrier component. Door cutouts of the elevator shaft, in particular, are assigned to floors of the building in which the elevator system is installed. Within this context, an accessible door cutout is understood as a door cutout, which is accessible using a magazine component via a floor and which enables access to the elevator shaft. One of the accessible door cutouts is designed in particular as the first door cutout above the so-called shaft pit of the elevator shaft.

In an embodiment of the present invention, a fixing phase is carried out before the loading phase, in which the carrier component is fixed within the elevator shaft in the lateral direction. This ensures that the magazine component can be safely disposed on the carrier component. In order to enable a secure fixing of the carrier component, it may be useful to dispose a mainly horizontally extending transverse strut in the door cutout. The fixing component of the carrier component can then be supported at this transverse strut and thus ensure a secure fixation.

In an embodiment of the present invention, the carrier component has a magazine receiving device, which can assume a mounting position and a loading position. In the mounting position of the magazine receiving device, mounting means from a magazine component disposed on the magazine receiving device can be removed from the installation component and the carrier component can be displaced in the elevator shaft. In the loading position of the magazine receiving device, a stocked magazine component accessible via a door cutout of the elevator shaft can be disposed on the magazine receiving device. Before the onset of a loading phase of the mounting device, the magazine receiving device is moved into the loading position and, before the onset of a mounting phase or displacement phase, is moved into the mounting position.

By moving the magazine receiving device into the mounting position, it is made possible that both the displacement phase and the mounting phase can be carried out safely and without damage to the magazine receiving device or the elevator shaft. Setting the loading position also enables safe performance of the loading phase.

In an embodiment of the present invention, the stocked magazine component is disposed on the carrier component via a door cutout of the elevator shaft. For this purpose, the magazine receiving device before the onset of a loading phase of the mounting device is moved into the loading position in such a way that a base of the magazine receiving device and a base of a floor associated with the door cutout are at the same level. This enables a safe and risk-free sliding of the magazine component onto the base of the magazine receiving device.

The "same level" should be understood here in such a way that the base of the magazine receiving device and the base of the mentioned floor are situated approximately at the same height, that is within the range of a few centimeters. The base of the magazine receiving device, in particular, rests on the base of the aforementioned floor in such a way that the two bases form an interconnected surface, which does not necessarily have to be completely flat. In doing so, a particularly safe sliding of the component onto the base of the magazine receiving device is possible.

It is also possible that the loading phase takes place in the shaft pit. For this purpose, one or a plurality of stocked magazine components are moved into the shaft pit and are there disposed on the carrier component. This can be useful if no door cutout of the elevator shaft is accessible.

The magazine receiving device, in particular, has a securing device, with the aid of which a magazine component accommodated by the magazine receiving device can be secured against displacement, that is to say, in particular secured against slipping or rolling away. The securing device is designed, for example, as a recess in the base of the magazine receiving device, in which rollers of the magazine component are disposed and, in this way, the magazine component is secured against rolling away. The securing device can also be designed, for example, as a recess in the base of the magazine receiving device, in which a suitably aligned pin of the magazine component is disposed during the loading phase and, in this way, the magazine component is secured.

In an embodiment of the present invention, in the loading phase, the positioning of the stocked mounting component on the carrier component takes place via an accessible door cutout of the elevator shaft, which is directly adjacent to a position of the carrier component in the preceding mounting phase. For this reason, the carrier component has to be displaced only slightly in the elevator shaft between the preceding mounting phase and the subsequent loading phase. The relocation thus takes very little time.

In this context, "directly adjacent" is to be understood such that no other accessible door cutout is situated between the door cutout selected for the loading phase and the position of the carrier component in the preceding mounting phase.

The door cutout selected for the loading phase may be the door cutout which is closest to the position of the carrier component in the previous mounting phase or the door cutout closest in the direction of installation. The mounting direction is from bottom to top if the installation starts from below, and vice versa. The first variant has the advantage that the shortest possible displacement of the carrier component is necessary. The second variant has the advantage that the carrier component is not displaced counter to the mounting direction.

In an embodiment of the present invention, it is planned in a planning phase at which door cutouts a loading phase is to take place and, in a supply phase, stocked magazine components are provided at door cutouts provided for a loading phase. This makes the provision particularly effective.

Determining the door cutouts, at which a loading phase is to take place, is carried out on the basis of the number of mounting means accommodatable by the magazine device and the number of mounting means necessary for each floor. On the basis of these numbers, it can be very easily determined on which floors a loading phase must take place. It may also result from the planning phase that the magazine components are not fully stocked, but are only stocked with as many mounting means as necessary until the next scheduled loading phase. For these calculations, a small reserve of mounting means can additionally be planned. The supply phase can in particular be carried out in one go before starting the installation. But it is also possible that the supply phase will be interrupted again and again. It merely has to be ensured that, at the time when a loading phase is to be carried out via a door cutout, a stocked magazine component is provided.

In an embodiment of the present invention, disposing the stocked magazine component on the carrier component is carried out in an automated manner in the loading phase. Thus, no installer is necessary in the loading phase, and the mounting device can work independently over a long period of time. As a result, the installation of the elevator system can be carried out particularly quickly and cost-effectively.

The automated positioning of the magazine component at the carrier component can be realized in different ways. For example, the installation component may dispose a magazine component provided on a floor at the carrier component, for example, pull onto the base of the magazine receiving device. Prior to that, the installation components can remove an empty magazine component from the carrier component, for example slide it from the base of the magazine receiving device onto the base of the floor.

Alternatively, an autonomous mobile robot may be used. Such robots can move and act independently in their environment. The robot can first remove an empty magazine component from the carrier component and subsequently dispose a stocked magazine component at the carrier component. For this purpose, the robot, for example, can couple with the magazine component and, in doing so, move it.

Moreover, it is possible that the magazine components have a drive and a control, in other words, be designed as a kind of autonomous mobile robot. If the magazine receiving device is in the loading position, an empty magazine component designed in such a way can independently move away from the carrier component and subsequently automatically dispose a stocked magazine component at the carrier component, thus, for example travel to a base of the magazine receiving device.

In addition to an automated positioning of the magazine component at the carrier component, a positioning by an installer is also conceivable. For this purpose, suitable aids such as specially adapted levers or rods can be used.

In an embodiment of the present invention, the magazine receiving device is situated pivotably on the carrier component. Thus, the magazine receiving device is returnable from the mounting position into the loading position in a particularly simple and inexpensive way.

The magazine receiving device is disposed on the carrier component in particular in such a manner that it can be pivoted in the direction of a door cutout and away from a door cutout. In particular, the magazine receiving device is disposed on the bottom of the carrier component. This information refers to a functional state of the mounting device. In this state, the mounting device is situated in an elevator shaft in such a manner that it can be moved in the elevator shaft, carry out the above mounting steps and can be supplied with stocked magazine component.

In an embodiment of the present invention, an energy store is disposed between the carrier component and the magazine receiving device in such a way that a torque acts upon the magazine receiving device, which is aligned from the mounting position in the direction of the loading position. Thus, the torque is aligned in such a manner that it moves the magazine receiving device, given a sufficient size and if the rotation is not blocked, from the mounting position into the loading position. Thus, the magazine receiving device can be moved into the loading position without an actuator and thus in a particularly simple and inexpensive manner.

The energy store is designed in particular as a spring, in particular a tension spring, it may, for example, also be designed as a compression spring, an air accumulator, or a hydraulic accumulator.

In an embodiment of the present invention, the aforementioned energy store is designed so that it can move a magazine receiving device with an empty or at least almost empty magazine component into the loading position. This is possible if the pivoting of the magazine receiving device is not blocked by a blocking device. If the magazine receiving device has more than one magazine component, the term "empty or at least almost empty" applies to all magazine components.

In an embodiment of the present invention, the mentioned energy store is designed so that a stocked magazine receiving device can move independently from the loading position into the mounting position. This is possible if the pivoting of the magazine receiving device is not blocked, that is, for example, if the base of the magazine receiving device does not rest on the base of the floor. Pivoting is possible in this case when the carrier component is lifted. Thus, no actuator is necessary also for the pivoting of the magazine receiving device from the loading position into the mounting position, and the pivoting can thus be realized easily and inexpensively.

In this context, a stocked magazine receiving device should be understood to mean a magazine receiving device which has received at least one stocked magazine component. In this instance, a stocked magazine component is a magazine component, in which mounting means are disposed.

In an embodiment of the present invention, a controllable blocking device is disposed on the carrier component, which can assume a resting position and a blocking position. In the resting position, a pivoting of the magazine receiving device from the mounting position in the direction of the loading position is possible and is blocked in the blocking device. In doing so, it can be easily and inexpensively prevented that the magazine receiving device moves independently from the mounting position into the loading position. This ensures that the carrier component can be safely displaced in the elevator shaft even having an empty magazine receiving device.

The blocking device can be designed, for example, as a bolt or pin extendible with the aid of an actuator, which in one position prevents the pivoting of the magazine receiving device and permits it in another position. The actuator may for example be designed as an electric motor and be controlled by a control device. The aforementioned control device, in particular, also controls other actuators of the mounting device, for example, the fixing component or also the displacement component.

Additional advantages, features, and details of the present invention result on the basis of the subsequent description of exemplary embodiments and on the basis of the drawings, in which the same or functionally identical elements are provided with identical reference characters. The drawings are only schematic and not to scale.

DETAILED DESCRIPTION

Figure 1:
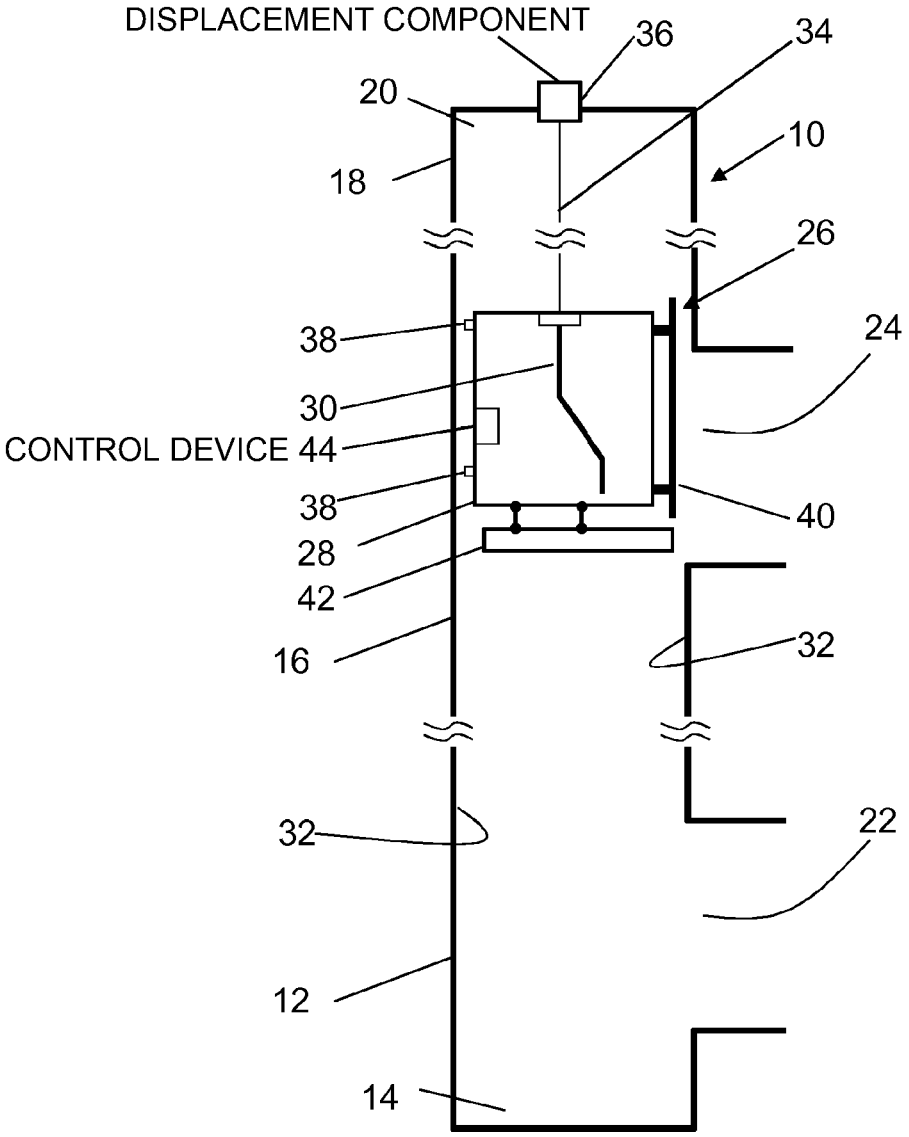
FIG. 1 shows a mounting device having a magazine receiving device in an elevator shaft in a side view.

FIG. 1 shows an elevator shaft 10 of an elevator system, in which a mounting device 26 is disposed. From elevator shaft 10, only a lower part 12 having a shaft pit 14, a middle part 16, and an upper part 18 including a shaft head 20 are shown. In the lower part 12 of elevator shaft 10, a lowermost door cutout 22 is disposed on a lowermost floor of a building, and in the middle part 16 an upper door cutout 24 is disposed on an upper floor. Door cutouts 22, 24 can be reached via the mentioned floors, and elevator shaft 10 is accessible via door cutouts 22, 24. For this reason, door cutouts 22, 24 are referred to as accessible door cutouts.

Mounting device 26 has a carrier component 28 and a mechatronic installation component 30. Carrier component 28 is designed as a frame, at which mechatronic installation component 30 is mounted. This frame has dimensions that enable to vertically displace carrier component 28 within elevator shaft 10, meaning to travel to different vertical positions at different floors within a building, for example. In the shown example, mechatronic installation component 30 is designed as an industrial robot which, hanging downwards, is attached to the frame of carrier component 28. One arm of industrial robot 30 can be moved relative to carrier component 28 and, for example, be displaced in the direction of a shaft wall 32 of elevator shaft 10.

Carrier component 28 is connected to a displacement component 36 in the shape of a motor-driven cable winch via a steel cable serving as suspension means 34, which is attached at the top of elevator shaft upper part 18 to the ceiling of elevator shaft 10. With the aid of displacement component 36, mounting device 26 can be vertically displaced inside elevator shaft 10 over an entire length of the elevator shaft 10.

Furthermore, mounting device 26 has a fixing component, with the aid of which carrier component 28 can be fixed inside elevator shaft 10 in a lateral direction, meaning in the horizontal direction. The fixing component is made up of two extendable props 38 and an elongated support member 40, support member 40 on the side of door cutouts 22, 24 and extendable props 38 being situated on the opposite side at carrier component 28. By extending props 38, carrier component 28 can be wedged between shaft walls 32 of elevator shaft 10 during a fixing phase.

At the bottom of carrier component 28, a magazine receiving device 42 is pivotably situated in the direction of door cutouts 22, 24. This magazine receiving device 42 serves to receive at least one, in particular two, magazine components not shown in FIG. 1. The magazine components may make mounting means, in particular in the form of rail brackets, also called brackets, and fastening means in the form of screws available to industrial robot 30 for installation on a shaft wall 32.

At support component 28, a control device 44 is disposed, which controls industrial robot 30 and not-shown actuators of extendable props 38.

Figure 2:
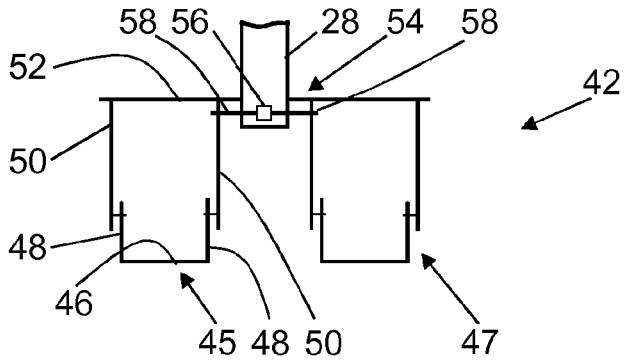
FIG. 2 shows a magazine receiving device in a front view.

As shown in FIG. 2, magazine receiving device 42 is designed as two parts, the two parts 45, 47 each being disposed on one side of carrier component 28. Since two parts 45, 47 are constructed identically, only first part 45 will be described. Part 45 of the magazine receiving device 42 has a U-shaped cross-section including a base 46 and side parts 48. Side parts 48 are situated pivotably on two holding arms 50 on a holding rod 52. The holding rod 52 is fixed to carrier component 28 and extends horizontally, so that part 45 of magazine receiving device 42 is pivotally situated in the direction of door cutouts 22, 24 on carrier component 28. Since the second part 47 is also disposed pivotably on carrier component 28 in the direction of the door cutouts 22, 24, this also applies to magazine receiving device 42.

Moreover, a blocking device 54, which has an actuator in the form of an electric motor 56 and two bolts 58 extendable and retractable horizontally from electric motor 56 in the direction of holding arms 50 of two parts 45, 47 of magazine receiving device 42, is disposed on carrier component 28. In a resting position of blocking device 54, two bolts 58 are retracted, so that a pivoting of two parts 45, 47, and thus magazine receiving device 42, is possible. In a blocking position of blocking device 54, two bolts 58 are extended, so that a pivoting of two parts 45, 47, and thus magazine receiving device 42, is blocked. In FIG. 2, the blocking position of blocking device 54 is shown. The electric motor 56 is also controlled by control device 44.

Figure 3:
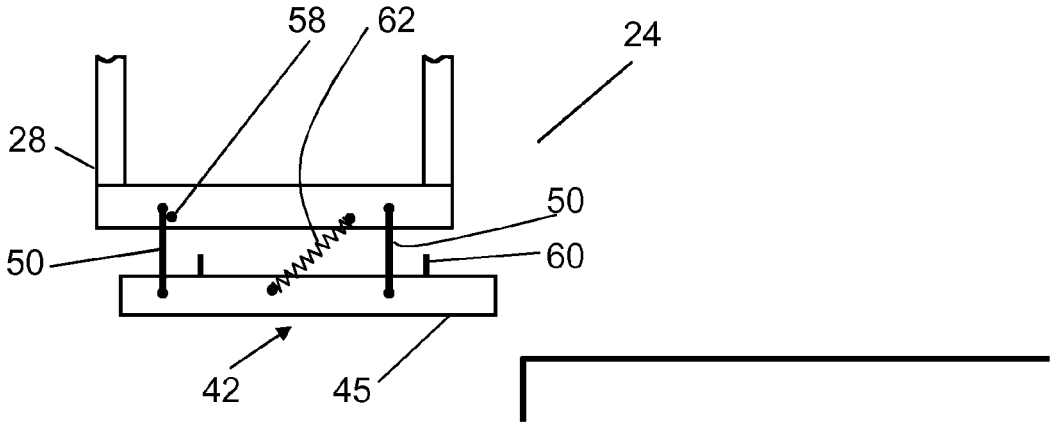
FIG. 3 shows a magazine receiving device in a mounting position having an empty tray component in a side view.

In FIG. 3, the magazine receiving device 42 is shown in a so-called mounting position. Starting from carrier component 28, holding arms 50 are aligned vertically downward. The blocking device is in the blocking position, bolts 58 are thus extended and magazine receiving device 42, for this reason, cannot pivot in the direction of upper door cutout 24. In the mounting position of magazine receiving device 42, industrial robot 30 can remove mounting means from a magazine component 60 disposed on magazine receiving device 42, and carrier component 28 can be displaced in elevator shaft 10.

Figure 4:
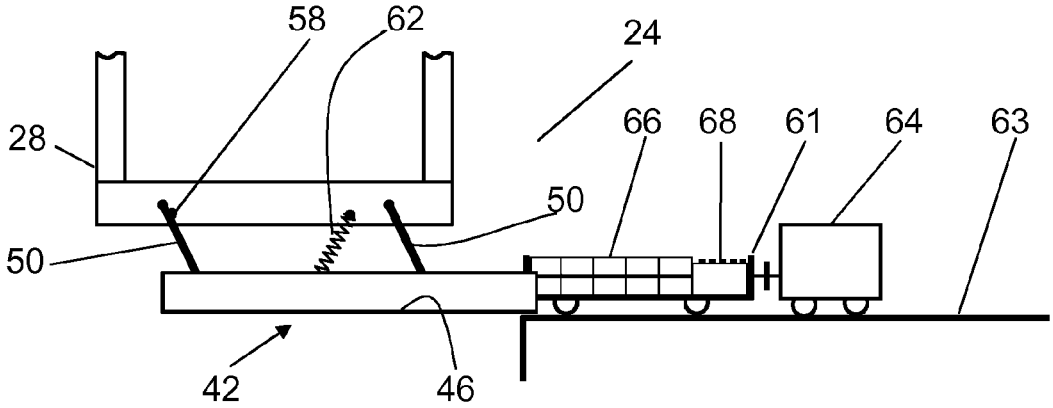
FIG. 4 shows the magazine receiving device of FIG. 3 in a loading position.

Between the carrier component 28 and the magazine receiving device 42 or the first part 45 of the magazine receiving device 42, an energy store in the form of a tension spring 62 is disposed in such a manner that a torque acts on magazine receiving device 42 or first part 45 of magazine receiving device 42, which from the mounting position shown in FIG. 3 is aligned in the direction of a loading position of magazine receiving device 42 shown in FIG. 4. Tension spring 62 thus exerts a force on magazine receiving device 42 or first part 45 of magazine receiving device 42, which has a component in the direction of door cutout 24. In an analogous manner, a second tension spring can be disposed between carrier component 28 and the second part of magazine receiving device 42.

Tension spring 62 is designed in such a manner that it can move magazine receiving device 42 having an empty or at least almost empty magazine component 60 into the loading position. Although magazine component 60 is empty in FIG. 3, however, since bolt 58 of blocking device 54 is simultaneously extended, the pivoting of magazine receiving device 42 is thereby blocked, magazine receiving device 42 nevertheless remains in the mounting position.

In FIG. 4, magazine receiving device 42 is shown in a so-called loading position. Starting from carrier component 28, holding arms 50 are pivoted in the direction of upper door cutout 24. The blocking device is in the resting position, bolts 58 are thus retracted so that magazine receiving device 42 could pivot in the direction of upper door cutout 24. In the loading position of magazine receiving device 42, a stocked magazine component 61 can be disposed on magazine receiving device 42 via upper door cutout 24.

To get from the position shown in FIG. 3 of magazine receiving device 42 into the position shown in FIG. 4, the blocking device is first moved into the resting position, thus bolt 58 is retracted. As described, since magazine component 60 in FIG. 3 is empty, the force of tension spring 62 is sufficient to pivot magazine receiving device 42 in the direction of upper door cutout 24. Subsequently, carrier component 28 and thus also magazine receiving device 42 are lowered as far in the elevator shaft until base 46 of magazine receiving device 42 rests on a base 63 of the floor assigned to upper door cutout 24. Two bases 46 and 63 thus are at the same level.

If two bases 46 and 63 are at the same level, first, carrier component 28 is fixed in the elevator shaft. Subsequently, empty magazine component 60 is removed from magazine receiving device 42 by an autonomous mobile robot 64. For this purpose, the autonomous mobile robot 64 couples to magazine component 60 having rollers and pulls it off base 46 of magazine receiving device 42. If more than one empty magazine component is present, the others are removed in the same way.

Subsequently, autonomous mobile robot 64 couples with a stocked magazine component 61. In magazine component 61 having rollers, a plurality of rail brackets 66 and screws 68 are disposed, which are required for the following mounting steps. Mobile autonomous robot 64 pushes stocked magazine component 61 onto base 46 of magazine receiving device 42 and thus disposes it at carrier component 28. If more than one loaded magazine component is present, the others are disposed on carrier component 28 in the same manner. Base 46 of magazine receiving device 42 has a recess, not shown, in which two rollers of magazine component 61 situated on one axis are disposed. In this way, magazine component 61 is secured against rolling away.

The empty magazine component can also be removed by an installer, possibly with the aid of suitable levers or rods, from the magazine receiving device. Likewise, the stocked magazine component can be pushed by an installer onto the base of the magazine receiving device.

Tension spring 62 is configured in such a manner that a stocked magazine receiving device 42, that is to say a magazine receiving device 42 having a fitted magazine component 61, can independently move from the loading position into the mounting position. The force of tension spring 62 is therefore not sufficient to keep stocked magazine receiving device 42 in the loading position. In FIG. 4, however, this is prevented by the fact that base 46 of magazine receiving device 42 rests on base 63 of the floor and, in so doing, the pivoting of magazine receiving device 42 is blocked.

The pivoting of magazine receiving device 42 is made possible only when the fixation of carrier component 28 is released and it is raised in the elevator shaft. This results in that the pivoting is no longer blocked and magazine receiving device 42 is pivoted against the force of tension spring 62 by its weight force into the mounting position.

Figure 5:
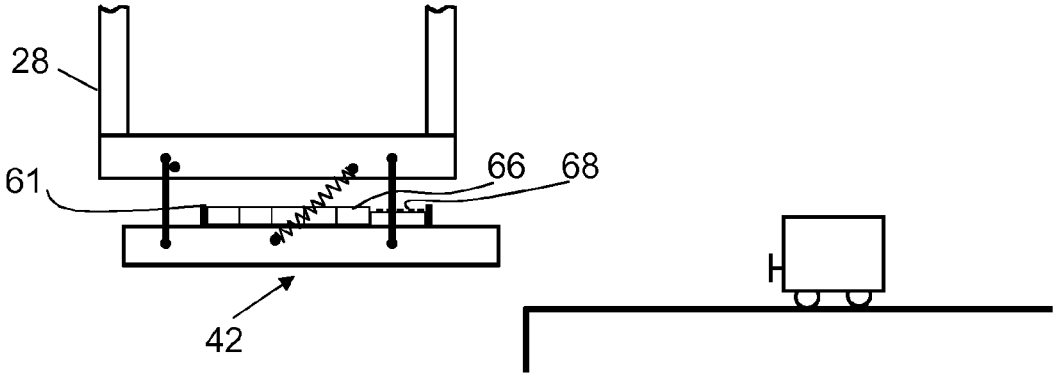
FIG. 5 shows the magazine receiving device of FIG. 3 in the mounting position having a stocked magazine component.

FIG. 5 shows magazine receiving device 42 after pivoting into the mounting position is completed. This position is identical to the position in FIG. 3. The difference between FIG. 3 and FIG. 5 is only that stocked magazine component 61 instead of empty magazine component 60 is disposed on carrier component 28. Mounting device 26 can now perform further installation steps and install mounting means in the form of rail brackets 66 and screws 68 on the shaft walls.

For the installation of rail brackets 66 in an elevator shaft 10 of an elevator system, first, displacement component 36 is fixed in shaft head 20 and is provided with suspension means 34. Subsequently, mounting device 26 is disposed in elevator shaft 10 and connected via suspension means 34 to displacement component 36.

Subsequently, magazine receiving device 42, as described in connection with FIGS. 3 and 4, is moved into the loading position at lower door cutout 22. After setting the loading position, carrier component 28 in a fixing phase is fixed laterally in elevator shaft 10. For this purpose, props 38 are extended and thus carrier component 28 is wedged in elevator shaft 10. After completion of the fixation phase, two stocked magazine components 61 are disposed on carrier component 28, as described in connection with FIGS. 4 and 5, thus a loading phase is carried out. The magazine components were either stocked outside the elevator shaft 10 in a stocking phase or were delivered already stocked to the building, in which the elevator shaft is located. The stocking phase then took place outside the building.

After completion of the loading phase, props 38 are again retracted and thus the fixation of carrier component 28 is released in the lateral direction. Mounting device 26 can thus carry out a plurality of mounting steps. For this purpose, the mounting device is displaced in a plurality of displacement phases in relation to elevator shaft 10 and is positioned at different heights within elevator shaft 10. After a positioning, in each mounting phase, rail brackets 66 are installed to shaft walls 32 using screws 68 at different heights in elevator shaft 10.

Since the two magazine components cannot accommodate all rail bracket 66 needed for entire elevator shaft 10 and screws 68, empty magazine components have to be replaced with stocked magazine components. In order to be able to execute this task as quickly as possible, the magazine components not always are exchanged via lowermost door cutout 22, but via an accessible door cutout of elevator shaft 10, which is directly adjacent to a position of carrier component 28 in the previous mounting phase.

Since it is already known prior to the installation of rail brackets 66, at which positions in the elevator shaft how many rail brackets are installed using how many screws, it is planned in a planning phase, which takes place in particular before the onset of the installation, at which door cutouts a loading phase will be necessary. On the basis of this planning, stocked magazine components 61 in a supply phase are provided at door cutouts provided for a loading phase. The supply phase can in particular be carried out in one session before the onset of the installation. But it is also possible that the supply phase will be interrupted again and again. It merely has to be ensured that a stocked magazine component 61 is also provided at the time at which a loading phase is to be carried out via a door cutout.

Finally, it should be noted that terms such as "comprising", "including", etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for carrying out an installation operation in an elevator shaft of an elevator system using a mounting device having a carrier component and a mechatronic installation component held on the carrier component, comprising the following steps:

carrying out a displacement phase of the installation operation by displacing the carrier component relative to the elevator shaft and positioning the carrier component at different heights within the elevator shaft;

carrying out a mounting phase of the installation operation by at least partially automatically performing a mounting step with the installation component, wherein a mounting means is removed from a magazine component disposed on the carrier component and installed on a shaft wall of the elevator shaft;

carrying out a stocking phase of the installation operation before the mounting phase by stocking the magazine component with the mounting means with the magazine component outside the elevator shaft; and carrying out a loading phase of the installation operation by disposing the stocked magazine component on the carrier component in the elevator shaft before the mounting phase.

2. The method according to claim 1 including, before carrying out the loading phase, carrying out a fixing to fix the carrier component in a lateral direction within the elevator shaft.

3. The method according to claim 1 wherein the carrier component has a magazine receiving device moveable between a mounting position and a loading position, wherein in the mounting position of the magazine receiving device the mounting means can be removed from the magazine component disposed on the magazine receiving device by the installation component, and the carrier component can be displaced in the elevator shaft, and in the loading position of the magazine receiving device the stocked magazine component can be disposed on the magazine receiving device via an accessible door cutout of the elevator shaft, and moving the magazine receiving device before an onset of the loading phase of the mounting device into the loading position and moving the magazine receiving device before an onset of the mounting phase or the displacement phase into the mounting position.

4. The method according to claim 3 including disposing the stocked magazine component on the carrier component via a door cutout of the elevator shaft, and moving the magazine receiving device before the onset of the loading phase of the mounting device into the loading position such that a base of the magazine receiving device and a base of a floor associated with the door cutout are at a same level.

5. The method according to claim 1 including, in the loading phase, disposing the stocked magazine component on the carrier component via an access door cutout of the elevator shaft, the access door cutout being directly adjacent to a position of the carrier component in a previous mounting phase.

6. The method according to claim 1 including planning, in a planning phase, at which door cutouts of the elevator shaft the loading phase should take place, and providing, in a supply phase, ones of the stocked magazine components at the planned door cutouts for the loading phase.

7. The method according to claim 1 including, in the loading phase, disposing the stocked magazine component on the carrier component in an automated manner.

8. A mounting device for carrying out an installation operation in an elevator shaft of an elevator system, comprising:

a carrier component;

a mechatronic installation component held on the carrier component;

wherein the carrier component is displaceable, in a displacement phase of the installation operation, relative to the elevator shaft and can be positioned at different heights within the elevator shaft;

wherein, in a mounting phase of the installation operation, the installation component can carry out a mounting step at least partially automatically to remove a mounting means from a magazine component disposed on the carrier component and to install the mounting means at a shaft wall of the elevator shaft;

wherein the carrier component includes a magazine receiving device movable between a mounting position and a loading position for receiving the magazine component;

wherein, in the mounting position, the mounting means can be removed from the magazine component disposed on the magazine receiving device by the installation component and the carrier component can be displaced in the elevator shaft; and wherein, before the mounting phase and in the loading position, a stocked magazine component can be disposed on the magazine receiving device via an accessible door cutout of the elevator shaft and used as the magazine component during the mounting phase.

9. The mounting device according to claim 8 wherein the magazine receiving device is pivotally situated on the carrier component.

10. The mounting device according to claim 9 including an energy store disposed between the carrier component and the magazine receiving device to apply a torque upon the magazine receiving device, the torque being aligned from the mounting position in a direction of the loading position.

11. The mounting device according to claim 10 wherein the energy store moves the magazine receiving device having an empty one of the magazine component into the loading position.

12. The mounting device according to claim 10 wherein the energy store permits the magazine receiving device with the stocked magazine component to move independently from the loading position into the mounting position.

13. The mounting device according to claim 9 including a controllable blocking device movable between a resting position and a blocking position and disposed on the carrier component, wherein the blocking device in the resting position permits a pivoting of the magazine receiving device from the mounting position in the direction of the loading position and the blocking device in the blocking position blocks the pivoting of the magazine receiving device.

* * * * *